US010294574B2

(12) United States Patent
Whitten et al.

(10) Patent No.: US 10,294,574 B2
(45) Date of Patent: May 21, 2019

(54) LEVELERS FOR COPPER DEPOSITION IN MICROELECTRONICS

(71) Applicant: MacDermid Enthone Inc., Waterbury, CT (US)

(72) Inventors: Kyle Whitten, Hamden, CT (US); Vincent Paneccasio, Jr., Madison, CT (US); Thomas Richardson, Killingworth, CT (US); Eric Rouya, Oakland, CA (US)

(73) Assignee: MacDermid Enthone Inc., Waterbury, CT (US)

( * ) Notice: Subject to any disclaimer, the term of this patent is extended or adjusted under 35 U.S.C. 154(b) by 510 days.

(21) Appl. No.: 14/854,561

(22) Filed: Sep. 15, 2015

(65) Prior Publication Data

US 2016/0076160 A1 Mar. 17, 2016

Related U.S. Application Data

(60) Provisional application No. 62/050,574, filed on Sep. 15, 2014.

(51) Int. Cl.
*C25D 3/38* (2006.01)
*C25D 7/12* (2006.01)

(52) U.S. Cl.
CPC ..... *C25D 3/38* (2013.01); *C25D 7/123* (2013.01)

(58) Field of Classification Search
None
See application file for complete search history.

(56) References Cited

U.S. PATENT DOCUMENTS

| | | | | |
|---|---|---|---|---|
| 3,770,598 | A | 11/1973 | Creutz | |
| 4,036,711 | A * | 7/1977 | Kardos | C25D 3/38 205/296 |
| 4,110,176 | A | 8/1978 | Creutz | |
| 2006/0016693 | A1 | 1/2006 | Wang et al. | |
| 2013/0020203 | A1 * | 1/2013 | Roeger-Goepfert | C08G 73/0206 205/95 |
| 2013/0175179 | A1 | 7/2013 | Eckles | |
| 2013/0241060 | A1 | 9/2013 | Paneccasio, Jr. et al. | |
| 2014/0238868 | A1 | 8/2014 | Li et al. | |

FOREIGN PATENT DOCUMENTS

| | | |
|---|---|---|
| EP | 1069211 | 7/2001 |
| EP | 2302103 | 3/2011 |
| GB | 1597519 | 9/1981 |
| KR | 1020140106426 | 9/2014 |

OTHER PUBLICATIONS

International Search Report, PCT/IB15/57097, dated Feb. 5, 2016, 5 pages.
Written Opinion, PCT/IB15/57097, dated Feb. 5, 2016, 7 pages.

* cited by examiner

*Primary Examiner* — Stefanie S Wittenberg
(74) *Attorney, Agent, or Firm* — Carmody Torrance Sandak & Hennessey LLP

(57) ABSTRACT

A composition for electrolytic plating in microelectronics which contains a leveler that comprises the reaction product of an aliphatic di(t-amine) with an alkylating agent. Electrolytic plating methods employing the leveler, a method for making the leveler, and the leveler compound.

9 Claims, No Drawings

LEVELERS FOR COPPER DEPOSITION IN MICROELECTRONICS

REFERENCE TO RELATED APPLICATIONS

This application claims priority to U.S. provisional application 62/050,574 filed Sep. 15, 2014, the entire disclosure of which is incorporated by reference.

FIELD OF THE INVENTION

The present invention generally relates to additives for use in an electrolytic deposition chemistry and a method for depositing copper and copper alloys; and more specifically to leveler additives for use in an electrolytic plating solution and a method for copper metallization of interconnect features in semiconductor substrates.

BACKGROUND OF THE INVENTION

The demand for semiconductor integrated circuit (IC) devices such as computer chips with high circuit speed and high circuit density requires the downward scaling of feature sizes in ultra-large scale integration (ULSI) and very-large scale integration (VLSI) structures. The trend to smaller device sizes and increased circuit density requires decreasing the dimensions of interconnect features and increasing their density. An interconnect feature is a feature such as a via or trench formed in a dielectric substrate which is then filled with metal, typically copper, to render the interconnect electrically conductive. Copper has been introduced to replace aluminum to form the connection lines and interconnects in semiconductor substrates. Copper, having better conductivity than any metal except silver, is the metal of choice since copper metallization allows for smaller features and uses less energy to pass electricity. In damascene processing, interconnect features of semiconductor IC devices are metallized using electrolytic copper deposition.

In the context of semiconductor integrated circuit device manufacture, substrates include patterned dielectric films on semiconductor wafer or chip substrates such as, for example, $SiO_2$ or low-K dielectric films on silicon or silicon-germanium. Typically, a wafer has layers of integrated circuitry, e.g., processors, programmable devices, memory devices, and the like, built into one or more layers of dielectric on a semiconductor substrate. Integrated circuit (IC) devices have been manufactured to contain sub-micron vias and trenches that form electrical connections between layers of interconnect structure (via) and between devices (trench). These features typically have dimensions on the order of about 200 nanometers or less, such as about 150 nanometers, less than about 100 nanometers, or even less than about 50 nanometers.

The use of copper has introduced a number of requirements into the IC manufacturing process. First, copper atoms have a tendency to diffuse into the semiconductor's junctions, such as by current-induced migration, thereby disturbing their electrical characteristics. To combat this occurrence, a barrier layer, such as titanium nitride, tantalum, tantalum nitride, or other layers as are known in the art, is applied to the patterned dielectric prior to the copper metallization that involves copper seed layer deposition (typically by PVD process) followed by electrolytic copper deposition to achieve void-free filling. As the architecture of ICs continues to shrink, this requirement proves to be increasingly difficult to satisfy.

One conventional semiconductor manufacturing process is the copper damascene system. Specifically, this system begins by etching the circuit architecture into the substrate's dielectric material. The architecture is comprised of a combination of the aforementioned trenches and vias. Next, a barrier layer is laid over the dielectric to prevent diffusion of the subsequently applied copper layer into the substrate's junctions, followed by physical or chemical vapor deposition of a copper seed layer to provide electrical conductivity for a sequential electrochemical process. Copper to fill into the vias and trenches on substrates can be deposited by plating (such as electroless or electrolytic), sputtering, plasma vapor deposition (PVD), and chemical vapor deposition (CVD). It is generally recognized that electrochemical deposition is the best method to apply Cu since it is more economical than other deposition methods and can flawlessly fill into the interconnect features (often called "bottom up" growth or superfilling). After the copper layer has been deposited, excess copper is removed from the facial plane of the dielectric by chemical mechanical polishing, leaving copper in only the etched interconnect features of the dielectric. Subsequent layers are produced similarly before assembly into the final semiconductor package.

Copper plating methods must meet the stringent requirements of the semiconductor industry. For example, copper deposits must be uniform and capable of flawlessly filling the small interconnect features of the device, for example, with openings of 100 nm or smaller.

Electrolytic copper systems have been developed which rely on so-called "superfilling" or "bottom-up growth" to deposit Cu into various aspect ratio features. Superfilling involves filling a feature from the bottom up, rather than at an equal rate on all its surfaces, to avoid seams and pinching off that can result in voiding. Multi-part systems consisting of a suppressor and an accelerator as additives have been developed for superfilling, as in Too et al., U.S. Pat. No. 6,776,893, which discloses sulfide-based compounds for accelerating and a polyether-based compound for suppressing. Further improvements in bottom up filling are described in Paneccasio U.S. Pat. Nos. 7,303,992 and 7,815,786 which describe suppressors in which a polyether comprising a combination of propylene oxide (PO) and ethylene oxide (EO) is bonded to a nitrogen-containing species. As the result of momentum of bottom-up growth, the Cu deposit is thicker on the areas of interconnect features than on the field area that does not have features. These overgrowth regions are commonly called overplating, overburden, mounding, bumps, or humps. Smaller features generate higher overplating humps due to faster superfill speed. Larger features generally fill slower, which can lead to formation of dimples (also called underplate or underplating), and thus requires additional copper plating to achieve complete planarity. Additional copper plating to correct underplating may further exacerbate overplating. Overplating poses challenges for later chemical and mechanical polishing processes that planarize the Cu surface. A third organic additive called a "leveler" is typically used to address overgrowth and other issues, as in Commander et al., U.S. Pub. No. 2003/0168343 and Paneccasio et al. U.S. Pat. No. 8,608,933.

As chip architecture gets smaller, with interconnects having openings on the order of 100 nm and smaller through which Cu must grow to fill the interconnects, there is a need for enhanced bottom-up speed. That is, the Cu must fill "faster" in the sense that the rate of vertical growth from the feature bottom must be substantially greater than the rate of growth on the rest of areas, and even more so than in conventional superfilling of larger interconnects.

In addition to superfilling and overplating issues, microdefects may form when electrodepositing Cu for filling interconnect features. One defect that can occur is the formation of internal voids inside the features. As Cu is deposited on the feature side walls and top entry of the feature, deposition on the side walls and entrance to the feature can pinch off and thereby close access to the depths of the feature especially with features which are small (e.g., <100 nm) and/or which have a high aspect ratio (depth: width) if the bottom-up growth rate is not fast enough. Smaller feature size or higher aspect ratio generally requires faster bottom-up speed to avoid pinching off. Moreover, smaller size or higher aspect ratio features tend to have thinner seed coverage on the sidewall and bottom of a via/trench where voids can also be produced due to insufficient copper growth in these areas. An internal void can interfere with electrical connectivity through the feature.

Microvoids are another type of defect which can form during or after electrolytic Cu deposition due to abnormal Cu growth or grain recrystallization that happens after Cu plating, such as, for example, during high temperature anneal steps. U.S. Pub. No. 2003/0168343 discloses a method of using an electrolytic deposition chemistry comprising a leveler additive that increases the overall impurity (Cl, S, C, O, N) content of copper metallization in interconnect features.

Substantial improvements have been made in damascene copper plating of submicron features of semiconductor integrated circuit devices. For example the additives and plating compositions described in the aforesaid Commander and Paneccasio patent documents have represented significant advances in this area of technology.

Other features of microelectronic devices to be filled with copper include Through Silicon Vias. Through silicon vias are critical components of three-dimensional integrated circuits, and they can be found in RF devices, MEMs, CMOS image sensors, Flash, DRAM, SRAM memories, analog devices, and logic devices.

The dimensions of through silicon vias (TSVs) are several orders of magnitude larger than the submicron interconnects, but present their own set of problems in gap filling. The depth of a TSV depends on the via type (via first or via last), and the application. Via depth can vary from 3 to 500 microns, e.g., from 20 microns to 500 microns, typically between about 30 and about 250 microns, or between about 50 microns and about 250 microns. Via openings in TSV have had entry dimensions, such as the diameter, on the order of between about 200 nm to about 200 microns, typically between about 25 microns and about 75 microns.

Filling large size through silicon via in commercially practicable durations is a barrier to the commercial feasibility of devices employing TSVs. Experimental data obtained to date suggest that conventional electrolytic copper deposition methods employing compositions appropriate for damascene metallization (i.e., the composition comprises the three component superfilling additives including accelerator, suppressor, and leveler) are current density limited (such as about 0.10 A/dm$^2$. or less to get defect-free fill) and may require plating durations as long as 20 hours to completely metallize large dimension (e.g., greater than 50 micron diameter openings) through silicon via.

Arana et al. US 2007/0001266 and Lane et al. U.S. Pat. No. 7,081,408 describe various methods for filling through silicon vias.

Copper plating is also known from, e.g., Eilert (U.S. Pat. No. 7,111,149); Rumer et al. (U.S. Pat. No. 6,924,551); Shi et al. (U.S. Pub. No. 2007/0085198); Ramanathan et al. (U.S. Pub. No. 2007/0117348) Heck et al. (U.S. Pub. No. 2006/0264029); Williams et al. (U.S. Pub. No. 2006/0273455); Rangel (U.S. Pub. No. 2006/0278979); and Savastiouk et al. (U.S. Pub. No. 2005/0136635). But none of these references, which relate to through silicon via architectures and methods, disclose applicable copper metallization chemistries or plating durations sufficient to fill through silicon via features.

The additives, compositions and electrolytic plating processes described in Richardson et al. US 2013/0199935 represent a significant advance in the art of filling through silicon vias. In that application, the TSVs are filled from a plating solution that contains a source of copper ions, chloride ion, and a leveler selected from the group consisting of a quaternized dipyridyl compound and a reaction product of benzyl chloride with hydroxyethylpolyethyleneimine.

SUMMARY OF THE INVENTION

The present invention is directed to novel levelers, novel electrolytic plating solutions, methods of preparing useful levelers, methods for filling submicron features of integrated circuit devices using plating solutions containing preferred levelers, methods for filling through silicon vias using plating solutions containing preferred levelers, and microelectronic devices prepared by processes which comprise filling submicron features of an integrated circuit device, or filling through silicon vias, by electrolytic deposit of copper from plating baths containing the preferred levelers. The invention is further directed to novel processes for building copper bumps and pillars in wafer level packaging.

In one aspect, novel leveler compounds comprise the reaction product of an aliphatic di(t-amine) with a bifunctional alkylating agent corresponding to the formula:

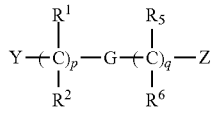

(I)

wherein: G is selected from the group consisting of a single covalent bond, —O—, O-((A)$_r$-O)$_s$— and -((A)$_r$-O)$_s$—; A has the structure —CR$^3$R$^4$— or C(R$^3$)(R$^4$)C(R$^{33}$)(R$^{34}$)—; each of p and r is independently an integer between 1 and 6 inclusive, s is an integer between 1 and 10 inclusive, q is an integer between 0 and 6 inclusive; each of R$^1$, R$^2$, R$^3$, R$^4$, R$^5$, R$^6$ and R$^{34}$ is independently selected from the group consisting of hydrogen and substituted or unsubstituted aliphatic hydrocarbyl comprising 1 to 4 carbon atoms; R$^{33}$ is substituted or unsubstituted aliphatic hydrocarbyl having 1 to 4 carbon atoms, Y is a leaving group selected from the group consisting of chloride, bromide, iodide, tosyl, triflate, sulfonate, mesylate, methosulfate, fluorosulfonate, methyl tosylate, and brosylate, Z is selected from the group consisting of R$^{30}$ and a leaving group independently selected from the same group as Y, and R$^{30}$ is selected from the group consisting of aliphatic hydrocarbyl, hydroxyl, alkoxy, cyano, carboxyl, alkoxycarbonyl, and amido, and when -G- is other than a single covalent bond, q is at least one.

In another aspect, the leveler compound comprises an oligomer or polymer compound selected from the group consisting of salts comprising a cation having the structure:

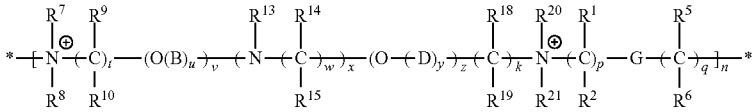

(III)

or

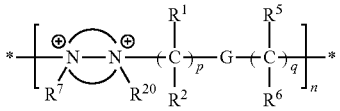

(IV)

wherein: G and A are as defined above; B has the structure;

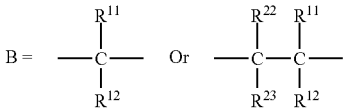

D has the structure;

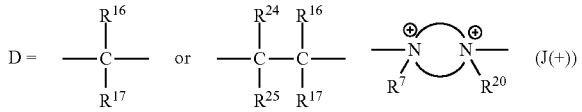

(J(+))

is the residue of an N,N'-dialkyl heterocyclic diamine bonded to —$(CR^1R^2)_p$-G-$(CR^5R^6)_q$]— at the respective t-amine sites to form a di(quaternary ammonium) cationic structure;

each of p, r, t, u, w and y is an integer between 1 and 6 inclusive, each of q, v, x, k, and z is independently an integer between 0 and 6 inclusive, s is an integer between 1 and 10 inclusive, k is at least one when v or x is other than 0, q is at least one when G is other than a single covalent bond; each of $R^1$ to $R^6$, $R^9$ to $R^{19}$, $R^{23}$, $R^{25}$ and $R^{34}$ is independently selected from the group consisting of hydrogen or lower alkyl comprising 1 to 4 carbon atoms, each of $R^7$, $R^8$, $R^{20}$, $R^{21}$, $R^{22}$, $R^{24}$ and $R^{33}$ is independently selected from the group consisting of substituted or unsubstituted aliphatic hydrocarbyl having 1 to 4 carbon atoms; and n is between 1 and about 30.

In a further aspect, the leveler compounds comprise compounds corresponding to the formula:

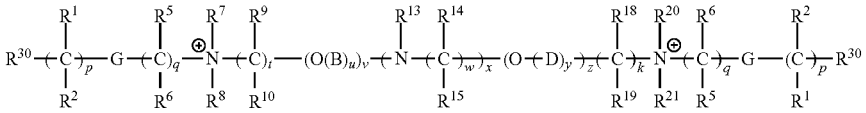

(VII)

or

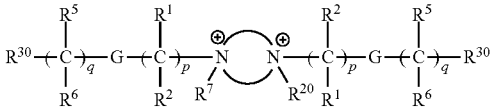

(VI)

wherein: G, A, B and D are as defined above;

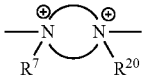

(J(+))

is the residue of an N,N'-dialkyl heterocyclic diamine bonded to —$(CR^1R^2)_p$-G-$(CR^5R^6)_q$]— at the respective t-amine sites to form a di(quaternary ammonium) cationic structure; each of p, r, t, u, w and y is an integer between 1 and 6 inclusive, each of q, v, x, k, and z is independently an integer between 0 and 6 inclusive, s is an integer between 1 and 10 inclusive, k is at least one when v or x is other than 0, q is at least one when G is other than a single covalent bond; each of $R^1$ to $R^6$, $R^9$ to $R^{19}$, $R^{23}$, $R^{25}$ and $R^{34}$ is independently selected from the group consisting of hydrogen or lower alkyl comprising 1 to 4 carbon atoms, each of $R^7$, $R^8$, $R^{20}$, $R^{21}$, $R^{22}$, $R^{24}$ and $R^{33}$ is independently selected from the group consisting of substituted or unsubstituted aliphatic hydrocarbyl having 1 to 4 carbon atoms; and $R^{30}$ is selected from the group consisting of aliphatic hydrocarbyl, hydroxyl, alkoxy, cyano, carboxyl, alkoxycarbonyl, and amido.

Where structure III or VII includes a tertiary amine site, i.e., where x has a value of at least 1, cross-linking may occur at the amine site with another structure III polymer or structure VII compound based on reaction with bifunctional alkylating agent of structure I during synthesis of the leveler. Such cross-linked structures are also functional as levelers in the applications described herein.

The novel levelers are used in processes for electrodeposition of copper on a dielectric or semiconductor base structure. A metalizing substrate comprising a conductive layer on the base structure is contacted with an aqueous electrolytic deposition composition; and electrical current is supplied to the electrolytic deposition composition to deposit copper on the substrate. The aqueous electrolytic composition comprises copper ions; an acid; a suppressor; and a leveler composition or compound as defined above and/or further defined hereinbelow.

Other objects and features will be in part apparent and in part pointed out hereinafter.

DESCRIPTION OF THE PREFERRED EMBODIMENTS

Novel electrolytic plating compositions and methods have been developed for use in electrolytic deposition of copper in the manufacture of semiconductor integrated circuit devices. More particularly, the novel compositions and methods are effective for filling submicron features of such devices, as well as filling through silicon vias which, e.g., allow electrical interconnection between two or more wafers bonded to each other in a three-dimensional wafer stack. The compositions and processes are also useful for building copper bumps and pillars in wafer level packaging.

The novel plating compositions contain levelers of two generically different compositions.

The first class of levelers comprises a predominantly linear configuration that include both ether linkages and quaternized ammonium ions. In preferred embodiments, the leveler may be prepared by reaction of a di(t-amine) with an alkylating agent corresponding to the formula:

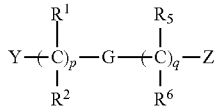

(I)

wherein G is selected from the group consisting of a covalent single bond, —O—, O—((A)$_r$-O)$_s$— and -((A)$_r$-O)$_s$—, A has the structure

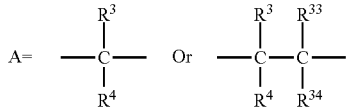

each of p, q and r is independently an integer between 1 and 6 inclusive, s is an integer between 0 and 10 inclusive, each of $R^1$, $R^2$, $R^3$, $R^4$, $R^5$, $R^6$ and $R^{34}$ is independently selected from the group consisting of hydrogen and substituted or unsubstituted aliphatic hydrocarbyl comprising 1 to 4 carbon atoms, $R^{33}$ is substituted or unsubstituted aliphatic hydrocarbyl having 1 to 4 carbon atoms, Y is a leaving group selected from the group consisting of chloride, bromide, iodide, tosyl, triflate, sulfonate, mesylate, methosulfate, fluorosulfonate, methyl tosylate, and brosylate, Z is selected from the group consisting of $R^{30}$ and a leaving group independently selected from the same group as Y, and $R^{30}$ is selected from the group consisting of aliphatic hydrocarbyl, hydroxyl, alkoxy, cyano, carboxyl, alkoxycarbonyl, and amido. Inasmuch as the process for making the leveler compound yields oligomer and/or polymer compounds, plus some small fraction (<2% by weight) of single reaction species which are a product of a single di(t-amine) and alkylating agent, in many instances the leveler compound comprises single reaction species in addition to oligomer and/or polymer.

Particularly suitable di(t-amine) reactants include: N,N'-dialkyl heterocycles and compounds corresponding to the formula:

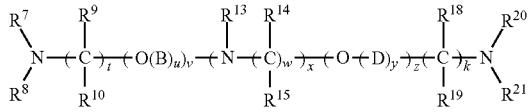

(II)

wherein B has the structure

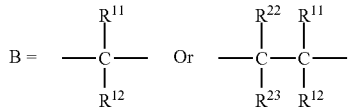

and D has the structure

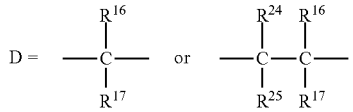

each of t, u, w and y is independently an integer between 1 and 6 inclusive, and each of v, x, z and n is independently an integer between 0 and 6 inclusive, each of $R^7$, $R^8$, $R^{13}$, $R^{20}$ and $R^{21}$, $R^{22}$, $R^{24}$ and $R^{33}$ is independently selected from lower alkyl substituents comprising 1 to 4 carbon atoms, and each of each of $R^9$ to $R^{12}$, $R^{14}$ to $R^{19}$, $R^{23}$, $R^{25}$ and $R^{34}$ is independently selected from the group consisting of hydrogen and substituted or unsubstituted aliphatic hydrocarbyl groups comprising 1 to 4 carbon atoms.

Alternative di(t-amine) reactants include an N, N'-dialkyl heterocycle corresponding to the formula

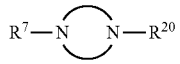

(J)

where R7 and R20 are as defined above.

Suitable levelers include novel compounds, polymers, and oligomers in the form of quaternary ammonium salts comprising a cation having the structure:

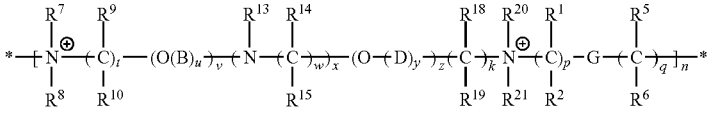

(III)

and

-continued

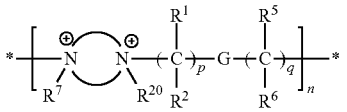

(IV)

wherein A has the structure,

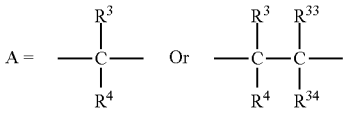

B has the structure,

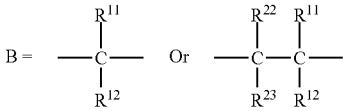

D has the structure,

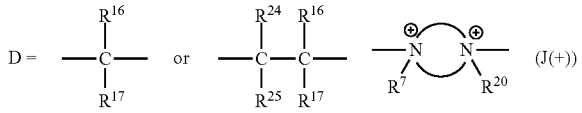

is the residue of an N,N'-dialkyl heterocyclic diamine bonded to —$(CR^1R^2)_p$-G-$(CR^5R^6)_q$]— at the respective t-amine sites to form a di(quaternary ammonium) cationic structure, each of t, u, w, y and, is an integer between 1 and 6 inclusive, s is an integer between 0 and 10 inclusive, each of v, x, n and q is independently an integer between 1 and 6 inclusive, s is an integer between 0 and 10 inclusive, n is at least one when v or x is other than 0, q is t least one when s is other than zero, and each of $R^9$ to $R^{12}$, $R^{14}$ to $R^{19}$, $R^{23}$, $R^{25}$ and $R^{33}$ is independently selected from the group consisting of hydrogen or lower alkyl comprising 1 to 4 carbon atoms each of $R^1$, $R^2$, $R^3$, $R^4$, $R^5$, $R^6$, $R^{13}$, $R^{22}$, $R^{24}$ and $R^{34}$ is independently selected from the group consisting of hydrogen and substituted or unsubstituted aliphatic hydrocarbyl comprising 1 to 4 carbon atoms, and each of $R^7$, $R^8$, $R^{20}$, $R^{21}$, $R^{23}$ and $R^{33}$ is independently selected from the group consisting of substituted or unsubstituted aliphatic hydrocarbyl having 1 to 4 carbon atoms.

In the structures of Formula III and IV, it is further preferred that:

the value of s is at least one, or at least two; the value of x is at least one; R13 is alkyl; each of R7, R8, R13, R20, R21, R23, and R33 is methyl; and

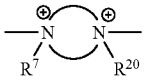

(J(+))

is the residue of a 5- or 6-membered N, N'-dialkylheterocycle such as, e.g., N,N'-dialkylpiperazine, N,N'-dialkylhexahydropyrimidine, and N,N'-dialkylimidazolidine, more preferably N,N'-dialkylpiperazine, most preferably N,N'-dimethylpiperazine.

Exemplary linear di(t-amine)s include N,N,N',N'-tetramethyl-1,2-diaminoethane, N,N,N',N'-tetramethyl-1,3-diaminopropane, bis(N,N-dimethyl-2-amino)ethyl ether, N,N,N',N'-tetramethyl-1,6-diaminohexane. N,N,N',N'-tetramethyl-1,4-diaminobutane N,N,N',N'-tetramethyl-1,4-Bis(aminomethyl)cyclohexane N,N,N',N'-tetramethyl-1,2-Bis(2-aminoethoxy)ethane Exemplary alkylating agents for compounds of formula III include bis(2-chloroethyl) ether, bis(2-chloroethoxy)ethane, 1,6-dichlorohexane, and the analogs of these compounds which contain bromide or other leaving group. Other specific alkylating agents include bis[2-(2-chloroethoxy)ethyl]ether, 1,3-dichloro-2-propanol, bis(4-chlorobutyl)ether, 1,3-dichloropropan-2-one, 1,2-di(2-chloroethyl)ether, 1,2-dichloroethane, 1,3-dichloropropane, 1,4-dichlorobutane, 1,5-dichloropentane, 1,6-dichlorohexane, 1,7-dichlorobutane, 1,8-dichlorooctane, and analogs of these compounds which contain bromide or other leaving groups.

Exemplary alkylating agents for the compounds of formula IV include 2-(2-hydroxyethoxy)ethyl chloride, 2-methoxyethyl chloride. 1-chloro-4-butanol, hexanol, octanol etc. (3-chloro-2-hydroxypropyl)trimethyl-ammonium chloride, (2-chloroethyl)trimethylammonium chloride, (2-chloroethoxy)benzene, Benzyl chloride, 4-Methylbenzyl chloride, allyl chloride.

Particularly preferred species of the first class of levelers are oligomers and polymers selected from among compounds having the structural formulas (as in the generic formulae set out above, the brackets indicated that the depicted structures are repeat units of a polymer or oligomer):

Structure

Compound 21

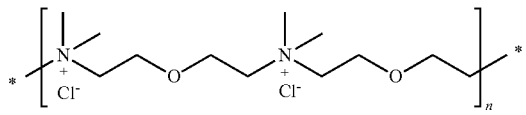

Structure

Compound 22

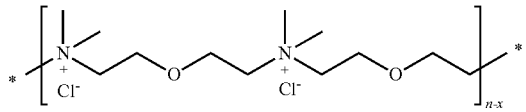

Structure

Compound 23

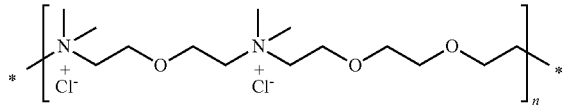

-continued

Structure

Compound 24

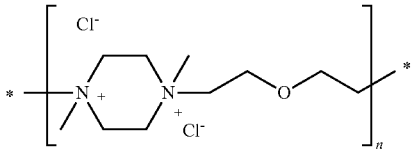

Structure

Compound 25

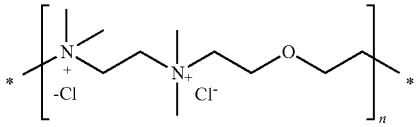

Structure

Compound 26

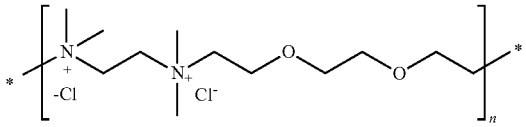

Structure

Compound 27

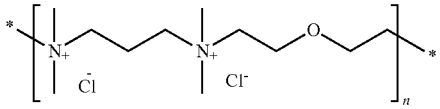

Structure

Compound 28

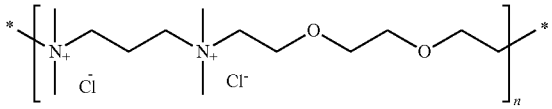

Structure

Compound 29

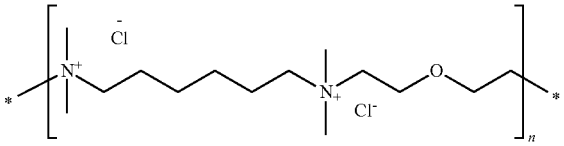

Structure

Compound 30

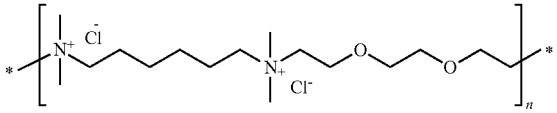

Structure

Compound 31

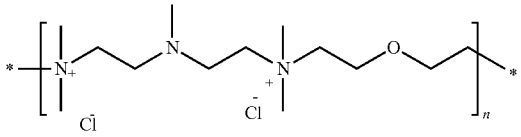

-continued

Structure

Compound 32

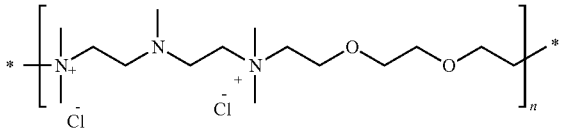

1.

Compound 33

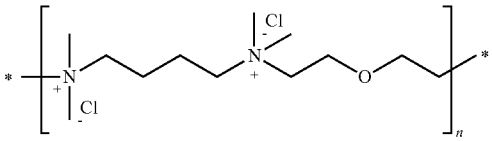

Compound 34

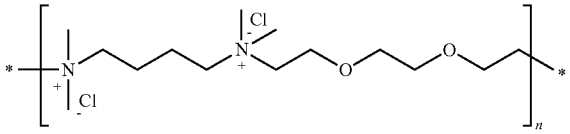

Compound 35

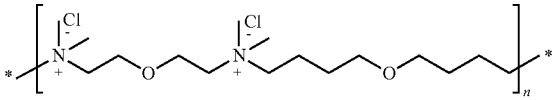

wherein n is between 1 and 30, e.g., between 2 and 30 or between 5 and 30, or between 5 and 20, and n−x is between 1 and 12, e.g., between 2 and 12, or between 3 and 12, or between 3 and 8. As noted above, compounds having a tertiary amine site, e.g., polymers 31 or 32, may cross-link through the amine site with another polymer chain to produce cross-linked polymer structure that may also function as a leveler.

In the process for preparation for the leveler compounds of the invention, a diamine is reacted with a difunctional alkylating agent to produce the quaternized structure. Preferably the diamine and the alkylating agent are dissolved and reacted in a polar organic solvent medium that is compatible with a copper electrolytic plating bath and the conditions under which copper is electrolytically deposited from a copper plating bath in applications such as filling TSVs or wafer level packaging. Preferably, the polar organic solvent medium has an atmospheric boiling point above a temperature at which the quaternization reaction proceeds at a satisfactory rate, e.g., at least 120°, at least 140° C., at least 150° C., or at least 160° C. Particularly suitable are polar solvents such as, e.g., ethylene glycol, diethylene glycol or other similar solvent having a boiling point greater than 180° C. Solvents such as dimethylformamide, N-methylpyridine or dimethylsulfoxide are preferably avoided because of possible adverse effect on plating performance where the reaction mixture produced by the leveler synthesis is incorporated into an electrolytic copper plating solution. The diamine is preferably present in an initial concentration between about 50 and about 400 g/L, more preferably between about 80 and about 250 g/L. Where the leveler product is polymeric, e.g., where the alkylating agent corresponds to the formula:

(I)

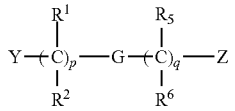

and each of Y and Z is a leaving group as described above, the alkylating agent is preferably present in an initial concentration between about 100 and about 450 g/L, more preferably between about 160 and about 280 g/L, and the molar ratio of alkylating agent to diamine is preferably between about 5:2 and about 1:2, more preferably between about 2:1 and about 1:1. Where the reactant of structure II comprises a tertiary amine site, as in the precursors of compounds 31 and 32, reaction with a bifunctional alkylating agent at the t-amine sites may result in modest cross-linking between the polymer and/or oligomer chains formed in the alkylation reaction.

Where the alkylating agent is monofunctional, i.e., where only one of Y and Z is a functional group and the other is $R^{30}$, the initial concentration of alkylating agent is preferably between about 160 and about 300 g/L, more preferably between about 220 and about 260 g/L, and the molar ratio of alkylating agent to diamine is preferably between about 5:2 and about 1:1. The reaction is preferably conducted at a temperature in the range of between about 23° C. and about 190° C., more typically between about 120° and about 180° C. The leveler reaction mixture is directly diluted in water to produce an aqueous solution that can be combined with accelerator, suppressor, chloride ion, copper salt and acid to yield a novel plating bath of the invention.

Alternatively, the leveler compound of the first class may be a non-polymeric compound wherein a di(t-amine) is alkylated at both nitrogens with a monofunctional alkylating agent otherwise comparable to that used in synthesis of the polymeric levelers described above. These non-polymeric levelers correspond to the structure:

(VII)

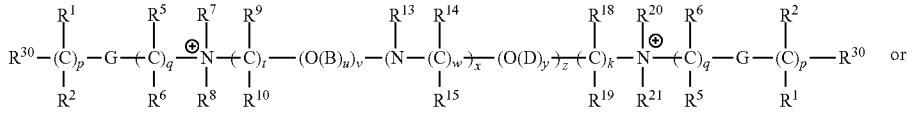

or (VI)

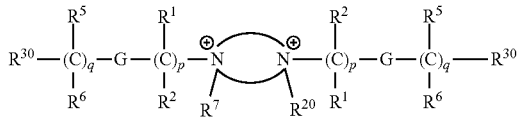

wherein G, A, B and D are as defined above, (J(+))

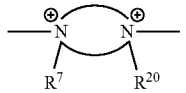

is the residue of an N,N'-dialkyl heterocyclic diamine bonded to —$(CR^1R^2)_p$-G-$(CR^5R^6)_q$]— at the respective t-amine sites to form a di(quaternary ammonium) cationic structure, each of p, r, t, u, w and y is an integer between 1 and 6 inclusive, each of q, v, x, k, and z is independently an integer between 0 and 6 inclusive, s is an integer between 1 and 10 inclusive, k is at least one when v or x is other than 0, q is at least one when G is other than a single covalent bond, each of $R^1$ to $R^6$, $R^9$ to $R^{19}$, $R^{23}$, $R^{25}$ and $R^{34}$ is independently selected from the group consisting of hydrogen or lower alkyl comprising 1 to 4 carbon atoms, each of $R^7$, $R^8$, $R^{20}$, $R^{21}$, $R^{22}$, $R^{24}$ and $R^{33}$ is independently selected from the group consisting of substituted or unsubstituted aliphatic hydrocarbyl having 1 to 4 carbon atoms, and $R^{30}$ is selected from the group consisting of aliphatic hydrocarbyl, hydroxyl, alkoxy, cyano, carboxyl, alkoxycarbonyl, and amido.

Particularly preferred non-polymeric levelers include those corresponding to the formulae:

Structure

Compound 36

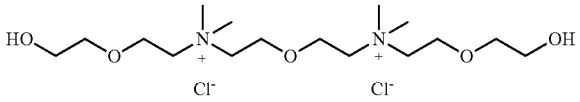

Compound 37

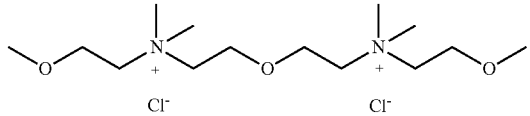

The use of aliphatic levelers described herein, both polymeric and non-polymeric, promotes formation of electrolytic copper deposits of high purity as may be important in applications such as wafer level packaging.

A separate class of levelers useful in the novel electrolytic plating methods comprise compounds prepared by the reaction of a dipyridyl or other di(t-amine) compound with a difunctional alkylating agent to produce and intermediate that is reacted with an N,N'-tetraalkylthiourea. For example:

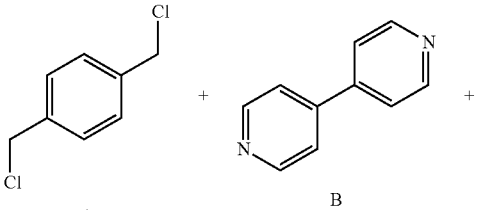

A B

-continued

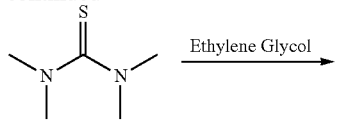

C

More generically, reactant A corresponds to the structure:

$$Y—(CR^{26}R^{27})_i—Ar—(CR^{28}R^{29})_j—Z$$

wherein each of Y and Z is a leaving group independently selected from among chloride, bromide, iodide, tosyl, triflate, sulfonate, mesylate, methosulfate, fluorosulfonate, methyl tosylate, and brosylate, Ar is an bivalent aryl residue derived, e.g., from benzene, toluene, xylene, naphthalene, etc., each of i and j is an integer between 1 and 12, inclusive, and each of $R^{26}$, $R^{27}$, $R^{28}$, and $R^{29}$ is independently selected from among hydrogen and lower alkyl having 1 to 4 carbon atoms. Exemplary compounds that can constitute reactant A are p-di(chloromethyl)benzene, 1,4-bis(2-chloroethyl)benzene, m-di(chloromethyl)benzene, and o-di(chloromethyl) benzene. Alternatively, A can also be described by structure (I).

Reactant B is optionally unsubstituted dipyridyl or dipyridyl that is mono- di-, or tri-substituted with any of various ring substituents, including, e.g., alkyl, aryl, aralkyl, hydroxy, alkoxy, aryloxy, cyano, amido, or carboxyl (i.e., hydroxycarbonyl). Exemplary compounds that can constitute Reactant B include dipyridyl, ethane, propane, or butane, and any of the di(tert-amine)s described by structure (II). Reactant C is preferably a compound that will react with the alkylating agent at the leaving group site, but will not propagate the polymeric reaction. Examples include pyridine, thiourea, and N,N,N',N'-tetralkylthiourea Alkyl substituents on the urea nitrogen are preferably selected from lower alkyl having 1 to 4 carbon atoms.

In preparation of the dipyridyl-based leveler, the dipyridyl compound B and the difunctional reactant A, both A and B are dissolved in a solvent medium, e.g., ethylene glycol, and reacted in the solvent medium, preferably at a temperature between about 120° C. and about 180° C. Reactant A is preferably present in an initial concentration between about 150 and about 200 g/L, more preferably between about 170 and about 180 g/L. Reactant B is preferably present in an initial concentration between about 50 and about 200 g/L, more preferably between about 70 and about 100 g/L, and molar ratio of Reactant A to Reactant B is preferably between about 3:1 and about 2:3, more preferably between about 1:1 and about 2:1. The reaction generates a salt comprising polymer or oligomer comprising a cation that comprises quaternized dipyridinium repeating units and repeating units comprising the residue of reactant A, and anions derived from the leaving groups Y and Z. The intermediate reaction mixture produced by reaction of reactants A and B is cooled to a temperature of preferably less than about 80° C., after which reactant C is added. The solution is then heated again between about 120° C. and about 180° C. to react with the A+B adduct to yield a reaction solution comprising the leveler compound.

Alternatively, reactant A can initially be reacted with reactant C to produce an adduct which is reacted with reactant B to produce the leveler. In this case again the intermediate reaction product is cooled to a temperature preferably below 80° C. before reactant B is added, and the resulting mixture is heated back to a temperature between 120° and 180° C. to complete the reaction. According to a still further alternative, reactants A, B and C can all be introduced into the reaction medium and simultaneously reacted to produce a solution comprising the leveler product. Weight average molecular weight of the thiourea-based levelers is typically in the range between about 1000 and about 5000. Where reactant C is N,N, N',N'-tetramethylthiourea, the weight average molecular weight may preferably range from about 300 to about 3000.

Regardless of the exact sequence in which the reactants are combined, a leveler compound produced from p-di (chloromethyl)benzene, dipyridyl and N,N'-tetramethylthiourea has the general structure:

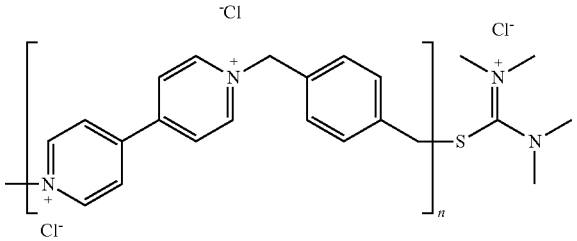

More generically, the novel levelers based on dipyridyl correspond to the above formula except that the substituent on the nitrogens of the thiourea residue may independently be selected from the group consisting of hydrogen and $C_1$ to $C_4$ alkyl and the dipyridyl residue and phenylene ring may each bear one or more of the ring substituents listed above. By way of further example, leveler compounds of the separate class may correspond to the structure:

$$-[-(\text{di}(t\text{-amine})\ \text{residue}))-(CR^{26}R^{27})_i—Ar—(CR^{28}R^{29})_j—]_n—S—C(=NR^{38}R^{39})^+—NR^{40}R^{41}$$

or $$-[-(\text{di-}(t\text{-amine})\ \text{residue}))-(CR^{1}R^{27})_p\text{-}G\text{-}(CR^{5}R^{6})_q—]_n—S—C(=NR^{38}R^{39})^+—NR^{40}R^{41}$$

where each of $R^{40}$ and $R^{41}$ is independently selected from the group consisting of hydrogen and $C_1$ to $C_4$ alkyl, each of i, j, p, q, $R^1$, $R^2$, $R^5$, $R^6$, $R^{26}$, $R^{27}$, $R^{28}$, $R^{29}$, Ar and G is as defined above, and the di(t-amine) residue is derived, e.g., from any of the dipyridyl or other di-(t-amine) compounds listed above. When prepared from reactants A, B and C as described above, the polymeric leveler may typically comprise a mixture of polymers, oligomers and non-polymeric species.

An electrolytic plating bath for plating semiconductor integrated circuit device preferably comprises copper ions in a concentration between about 0.3 and about 50 g/l, preferably between about 0.5 and about 20 g/l, e.g., in the form of a copper salt such as copper sulfate in a concentration between about 1 and about 40 g/l, an acid, preferably sulfuric acid in a concentration between about 3 and about 150 g/l, preferably between about 5 and about 50 g/l, an accelerator in a concentration between about 15 and about 200 ppm, preferably between about 25 and about 140 ppm, a suppressor in a concentration between about 50 and about 500 ppm, and a novel leveler of the invention in a concentration between about 0.5 and about 30 ppm, preferably between about 1 and about 15 ppm. Preferably, the plating bath also contains chloride ion, e.g., in the form of hydrochloric acid at a concentration between about 30 and about 100 ppm, or between about 50 and about 100 ppm.

In the process of electroplating a semiconductor integrated circuit device, a metalizing substrate comprising a seminal conductive layer is initially deposited along the bottom and sidewalls of the vias and trenches, and on those areas of the field to be plated with copper. Typically, the seminal conductive layer comprises a copper seed layer, or in some cases a conductive polymer such as a polythiophene, polypyrrole or polyaniline, or, in the case of wafer level packaging, an under bump metal pad formed on the semiconductor substrate. A copper seed layer may be applied over a dielectric or semiconductor base structure by conventional means such as physical or chemical vapor deposition. In Damascene plating, the base structure is ordinarily a silicon dioxide or other insulating layer formed or bonded on a silicon or other semiconductor chip or wafer. To prevent unwanted diffusion or electromigration of copper through the dielectric layer and into the semiconductor, a barrier layer is preferably interposed between the base structure and the metalizing substrate. The barrier layer may typically comprise titanium nitride, tantalum, tantalum nitride, tungsten nitride, and other metals and nitrides having comparable properties.

To carry out the plating step of the process, an electrolytic circuit is established comprising the electrolytic plating solution, an anode immersed in the plating solution, the metalizing substrate on a dielectric or semiconductor base structure that is formed on or provided by a semiconductor wafer or chip immersed in the electrolytic solution and spaced from the anode, and a DC power source having a positive terminal in electrical communication with the anode and a negative terminal in electrical communication with the metalizing substrate on the wafer or chip which functions as the cathode in the electrolytic circuit. DC current is caused to flow through the circuit, causing copper ions from the plating bath to be reduced at the cathodic surface and fill submicron vias and trenches or through silicon vias in the semiconductor substrate.

The combination of accelerator, suppressor and leveler in the plating bath promotes bottom up filling of the submicron features in the semiconductor substrate. Suppressors and levelers both inhibit the plating rate in the field and along the sidewalls of the vias and trenches.

The accelerators diffuse readily through the bulk electrolytic solution to the bottom of the vias and trenches, and through the boundary layer within the liquid phase at the surface of the metalizing substrate, to function as an electron transfer agent attached to the cathodic copper substrate as the latter grows on the seed layer or other seminal conductive layer. Copper ions, which are mobile, also diffuse readily through the boundary layer under the influence of the electrolytic field and accept electrons at the cathodic surface to deposit as metallic copper. Suppressors and levelers diffuse more slowly, thus resulting in a gradient of progressively decreasing suppressor and leveler concentration vs. depth within the vias and trenches, resulting in an inverse gradient of boundary layer resistance and a corresponding current gradient that promotes more rapid plating at the bottom of the submicron features.

The levelers are relatively large molecules having a weight average molecular weights typically in the range of 1000 to 5000. Apparently due to a combination of its size and charge density, the leveler typically diffuses more slowly than the suppressor. The slow diffusion rate, coupled with its strong charge, causes the leveler to concentrate at the areas of the metalizing substrate at the surface of an integrated circuit chip or wafer and in the very top reaches of the via. Where it attaches to the substrate, the leveler is not readily displaced by either the accelerator or the suppressor. As a further consequence of its size and charge, the leveler exhibits a strongly suppressive effect on electrodeposition of copper at the underlying substrate, thus directing the current away from the upper reaches of the via where the leveler concentration is highest to the bottom of the via where the leveler concentration is lowest, and thereby promoting growth of the deposit in the vertical direction faster than growth in the horizontal direction within the via. As long as the leveler is concentrated at the exterior surface (the field) of the chip (or other microelectronic device) and the upper reaches of the via, it is effective to retard electrodeposition at on those surfaces, thereby minimizing undesirable overburden and preventing pinching and formation of voids at or near the via entry. The novel levelers described herein have been found to possess favorable properties in promoting rapid bottom up filling with minimal formation of voids or overburden Preferably, the electrolytic deposition process operates at a current density between about 1 and about 10 $mA/cm^2$ and a wafer rotation rate of 10 to 100 rpm.

Electrolytic solutions which contain the novel leveler can be used in filling submicron features of semiconductor integrated circuit devices, e.g., vias and trenches having a dimension<1μ, more typically <100 nm, more preferably between 10 to 30 nm, most typically 20 to 30 nm, in width, and between 60 and 150 nm in depth. Even vias and trenches having a width in the range of 10 to 20 nm may be gap filled using the levelers, plating baths, and plating methods of the invention. Thus, the submicron features filled using the novel levelers may have aspect ratios>3:1, more typically >4:1, and most typically in the range between about 4:1 and about 10:1.

The novel aliphatic levelers described herein are especially effective for producing copper deposits of purity, and in particular deposits having relatively minimal content of impurities such as carbon, oxygen, chlorides, sulfur, and nitrogen. This is a signal and advantageous departure from the prior art. While a copper deposit having high impurity can have some advantages such as improving the stress migration resistance of devices, it may not always be advantageous to fill interconnect features in certain devices with copper deposits with high level of impurities. Rather, some devices, particularly memory devices, may require interconnect metallization with a more pure copper deposit. Such a pure copper layer is believed to be less susceptible to microvoiding, have better conductivity and improved resistance to electromigration. Plating baths containing the novel levelers further exhibit strong leveling performance for better planarization of the Cu overplate throughout a wafer pattern. Where the substrate presents a dense pattern of especially small interconnect sites, hump height is minimized and mounding is mitigated within a short time frame throughout a wafer pattern.

In substantially the same manner as described above, the novel levelers, electrolytic plating baths and electrolytic deposition processes are effective for filling through silicon vias (TSVs). TSVs are very small, but much larger than submicron interconnects. Typically, TSVs have an entry dimension between 1 micrometers and 100 micrometers, a depth dimension between 20 micrometers and 750 micrometers, and an aspect ratio greater than about 2:1, although somewhat lower and significantly higher aspect ratios are also encountered. For filling TSVs, the novel electrolytic plating baths may typically comprise between about 30 and about 80, preferably between about 40 and about 60 g/L copper ion, between about 50 and 120, preferably between about 70 and about 90 g/L acid, preferably sulfuric acid, between about 40 and about 60 ppm chloride ion, between about 2 and about 75, preferably between about 5 and about 50 ppm accelerator, between about 50 and about 300 ppm suppressor and between about 2 and about 50, preferably between about 3 and about 30 ppm leveler. Typical aspect ratios range from about 10 to about 25. The process preferably does not use hot entry. Preparatory to electrodeposition, a seminal conductive layer, ordinarily a seed layer is deposited on the wall of the TSV. Current wave form may vary.

The novel electrolytic plating baths may also be used in plating of printed wiring boards, and especially for plating blind vias and the walls of through holes. For printed wiring boards, the electrolytic bath preferably comprises between about 15 and about 80 g/L, e.g., between about 30 g/l copper ion, between about 70 and about 225 g/L, e.g., between about 150 and about 225 g/L acid, preferably sulfuric, and between about 50 and about 90 ppm chloride ion. Current density is preferably in the range between about 10 and about 40 A/ft$^2$.

The novel levelers are also effective in wafer level packaging applications wherein an electrolytic plating composition containing such a leveler can also be used for building copper bumps and pillars in flip chip packaging or other processes for wafer-level packaging of integrated circuits. In various applications of the electrodeposition process, including forming bumps or pillars, forming a redistribution layer, or filling TSVs, the cavity in which copper is to be deposited is first provided with a dielectric liner such as silicon dioxide or silicon nitride. The dielectric liner can be provided, e.g., by chemical vapor deposition or plasma vapor deposition. Alternatively, organic dielectrics can be used to mitigate a coefficient of thermal expansion mismatch. A photoresist wall of the cavity may have sufficient dielectric properties to obviate the need for a further dielectric layer, but the nature of the vapor deposition process may cause a further dielectric layer to form on the photoresist wall as well. A seminal conductive layer is then provided by either chemical vapor deposition of a seed layer or by application of a conductive polymer. In a process for forming bumps and pillars, the seminal conductive layer is deposited only at the bottom of the cavity. The bottom can be flat, or comprise a recess filled with polyimide that promotes better bonding. This embodiment of the process differs from filling TSVs, in which the seminal conductive layer is formed over the entire surface of the cavity, including bottom and sidewalls, and metalization is carried to deposit copper on both bottom and sidewalls.

The process can be used to provide the under bump metal pads for flip chip manufacturing in which case the metalizing substrate is limited to the faces of the bonding pads. Alternatively, with reference to the under bump metal as the floor, i.e., bottom, the process can be used to form a copper bump or pillar by bottom-up filling of the cavity formed at its floor by the under bump pad or under bump metal and on its sides by the wall of an opening in a stress buffer layer and/or photoresist that allows access to the pad or under bump metal. In the latter application, the aperture size of the cavity is roughly comparable to that of a blind through silicon via, and the parameters of the process for building the bump or pillar are similar to those used for filling blind TSVs. However, the concavity wall provided by openings in photoresist or stress-reducing material is ordinarily not seeded and is therefore non-conductive. Only a semiconductor or dielectric under bump structure at the floor of the cavity is provided with a seminal conductive layer, typically comprising a conductive polymer such as a polyimide. In such embodiments, the process is not as dependent on balance of accelerator and suppressor as it is in the case of bottom filling submicron vias or TSVs.

Plating baths useful in wafer level packaging are similar to those used for Damascene processes and filling TSVs. However, while sulfuric acid is strongly preferred in the latter applications, baths containing either sulfuric acid or alkane sulfonic acids such as methane sulfonic acid are highly advantageous for forming copper bumps and pillars. The novel compositions and processes are effective for forming bumps and pillars of varying dimensions, with a diameter or width ranging from 20 to 150μ and a height ranging from 20-210μ. Typically, megabumps have a diameter or width of 100 to 150μ and a height of 200 to 210μ, pillars, have a diameter or width of 40 to 60μ and a height of 40 to 100μ, and microbumps have both a diameter or width and a height in the range of 20 to 30μ. For each of these applications, the electrolytic plating bath preferably contains copper sulfate or a copper alkanesulfonate in a concentration between about 25 and about 100 g/L, sulfuric acid or an alkanesulfonic acid in a concentration between about 70 and about 150 g/l, and chloride ion in a concentration of about 30 to about 80 ppm. In a plating bath for forming microbumps and pillars, the acid concentration is preferably in the lower end of the aforesaid range, e.g., between about 70 and about 100 g/L, while in forming megabumps the acid concentration is preferably in the higher end of the range, e.g., 120 and about 150 g/L. Also in microbump and pillar applications, the concentration of copper salt is preferably between about 25 and about 60 g/L.

For megabump applications, the electrolytic bath preferably contains an accelerator in a concentration between about 20 and about 60 mg/L, a suppressor in a concentration between about 1000 and about 3000 mg/L and the leveler in a concentration between about 1 and about 60 mg/L. Preferred levelers for filling megabumps correspond to the formula: III:

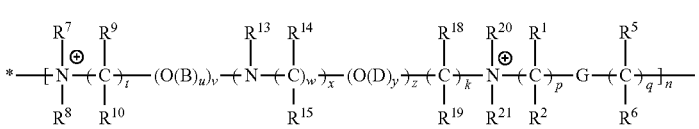

(III)

wherein v=0, x=0, z=0, t+k is in the range of 2 to 4, p+q is in the range of 3 to 5, and G is an ether oxygen —O—. It is further preferred that that t+k=3 and p+q=4, and that $R^1$, $R^2$, $R^5$, $R^6$, $R^7$, $R^8$, $R^9$, $R^{10}$, $R^{18}$ and $R^{19}$ are hydrogen. A particularly preferred leveler for such applications is compound 27 as depicted on p. 15 wherein $R^7$, $R^8$, $R^{20}$ and $R^{21}$ are also hydrogen. Using a bath of such composition a WIF of about 3% can be achieved.

Bumps and pillars produced using the levelers of structure (III) are generally free of Kirkendall voids, also free of impurities including Cl, S, O and C.

For forming microbumps and pillars having a diameter of, e.g., 20 to 80μ, plating bath preferably comprises a leveler produced by copolymerization of a di(t-amine) and a di(haloalkyl)aryl compound and terminated by condensation of a haloalkylaryl residue with an N,N'-tetralkylthiourea. More generally, the leveler preferred for microbump and pillar applications corresponds to the formula:

$$-[-(\text{di}(t\text{-amine})\ \text{residue}))-(CR^{26}R^{27})_i—Ar—(CR^{28}R^{29})_j—]_n—S—C(=NR^{38}R^{39})^+—NR^{40}R^{41}$$

or $$-[-(\text{di-}(t\text{-amine})\ \text{residue}))-(CR^{1}R^{27})_p\text{-}G\text{-}(CR^{5}R^{6})_q—]_n—S—C(=NR^{38}R^{39})^+—NR^{40}R^{41}$$

where each of $R^{40}$ and $R^{41}$ is independently selected from the group consisting of hydrogen and $C_1$ to $C_4$ alkyl, each of i, j, p, q, $R^1$, $R^2$, $R^5$, $R^6$, $R^{26}$, $R^{27}$, $R^{28}$, $R^{29}$, Ar and G is as defined above, and the di(t-amine) residue is derived, e.g., from any of the dipyridyl or other di-(t-amine) compounds listed above. An especially preferred leveler for forming microbumps and pillars may be produced from p-di(chloromethyl)benzene, dipyridyl and N,N'-tetramethylthiourea has the structure:

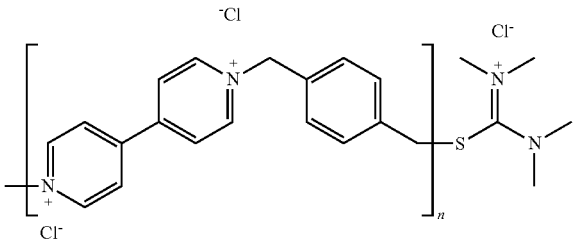

The novel plating bath and process are effective for producing bumps and pillars having a within feature (WIF) height variation of less than about 10% and a within die (WID) height variation of less than about 10% as well. Use of the dipyridyl based levelers is effective for achieving high plating speeds while controlling the configuration of bumps and pillars, and in particular for eliminating or controlling the height, depth and configuration of domes and dimples.

The following examples illustrate the invention.

Example 1

Into a 1 liter 3 neck round bottom flask with water condenser, stir bar, and thermometer is placed, all at once, 500 mL of ethylene glycol, 160.3 grams (1 mole) of Bis[2-(N,N-dimethylamino)ethyl]ether and 187.1 grams 1,2-Bis (2-chloroethoxy) ethane. The mixture is stirred at 400 rpm and heated slowly using a heating mantle with rheostat until an exotherm is observed around 135° C. with a max temperature of 185-188 C. The dark red mixture is heated between 170-180° C. for 1 hour and then allowed to cool to room temperature. The solution is brought to a final volume of 10 Liters using high purity deionized water.

Example 2

Ethylene Glycol (50 mL) is added to a 3-neck 250 mL round bottom flask equipped with stir bar, condenser, and thermometer. 4,4-dipyridyl (25 mmol), tetramethylthiourea (50 mmol), and a,a'-dichloro-p-xylene (50 mmol) are added to the reaction flask. The solution is stirred at 400 rpm and the solution is heated to 170° C. and allowed to stir at that temperature for 1 hour. The solution is allowed to cool to room temperature. The reaction solution is poured into a 1 L volumetric flask, the reaction flask is rinsed with water and poured into the volumetric flask and then the solution is brought to a volume of 1 L.

Example 3

Ethylene Glycol (50 mL) is added to a 3-neck 250 mL round bottom flask equipped with stir bar, condenser, and thermometer. Tetramethylthiourea (50 mmol), and a,a'-dichloro-p-xylene (50 mmol) are added to the reaction flask. The solution is stirred at 400 rpm and the solution is heated to 170° C. and allowed to stir at that temperature for 1 hour. The solution is allowed to cool to <80° C., at which, 4,4-dipyridyl (25 mmol) is added. The reaction mixture is then heated back to 170° C. and allowed to stir at that temperature for an additional hour. The solution is then allowed to cool to room temperature. The reaction solution is poured into a 100 mL volumetric flask and brought to volume with high purity deionized water.

Example 4

An electrodeposition bath was prepared containing $CuSO_4$ (50 g/L $Cu^{++}$), sulfuric acid (80 g/L), chloride ion (50 ppm), an accelerator (80 mg/L), an aryl ethoxylate suppressor comprising a combination of propylene oxide and ethylene oxide repeat units (400 mg/L), and a leveler compound produced from copolymerization of p-di(chloromethyl)benzene, dipyridyl and subsequent reaction with N,N'-tetramethylthiourea as described hereinabove (28 mg/L). This bath was brought into contact with an array of underbump metal sites in a flip chip die assembly and current was applied at a density effective to deposit copper at a rate between 1 and 8μ per minute, more typically between 2 and 3.5μ per minute. Plating was performed at a bath temperature in the range of 20-45° C., in particular, at room temperature. An array of copper pillars was formed on the underbump metal sites, each pillar having a diameter of approximately 40-60μ and a height of approximately 60-80μ, and having a domed configuration at its distal end. The WID for the array of microbumps was <10%. The height of the dome in each microbump extended no more than 4 to 6μ above a plane defined by the base of the dome within the bump structure, i.e., the WIF was not greater than 10%.

Example 5

Microbumps were formed on the underbump sites of a flip chip assembly in the manner described in Example 4 except that the copper salt component of the plating bath was cupric methanesulfonate in a $Cu^{++}$ ion concentration of 80 g/L, and the acid component was methanesulfonic acid (80 g/L). Again, each of WID and WIF was not greater than 10%.

Example 6

An electrodeposition bath was prepared containing $CuSO_4$ (50 g/L $Cu^{++}$), sulfuric acid (80 g/L), chloride ion (50 ppm), an accelerator (3 mg/L), a suppressor comprising a combination of propylene oxide and ethylene oxide repeat units bonded to a nitrogen-containing species (2,500 mg/L), and a leveler compound consisting of compound 27 (15 mg/L). This bath was brought into contact with an array of underbump metal sites in a flip chip die assembly and current was applied at density effective to deposit copper at rate of 1 to 8 μ/min. for example, 2 to 3.5 μ/min. Plating was performed at a bath temperature in the range of 20-45° C., in particular, at room temperature. An array of copper megabumps was formed on the underbump metal sites, each megabump having a diameter of 200μ and a height of approximately 200μ, and having a domed configuration at its distal end. The WID for the array of megabumps was <10%. The height of the dome in each megabump extended no more than 20μ above a plane defined by the base of the dome within the bump structure, i.e., the WIF was not greater than 10%.

Example 7

Megabumps were formed on the underbump sites of a flip chip assembly in the manner described in Example 4 except that the copper salt component of the plating bath was cupric methanesulfonate in a $Cu^{++}$ ion concentration of 80 g/L, and the acid component was methanesulfonic acid (80 g/L). Again, each of WID and WIF was not greater than 10%.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawing[s] shall be interpreted as illustrative and not in a limiting sense.

The invention claimed is:

1. An aqueous electrolytic composition useful in filling submicron features of a semiconductor integrated circuit device or through silicon vias, the composition comprising:

an acid;

copper ions; and a leveler that comprises an oligomer and/or polymer compound comprising salts comprising a cation having a structure:

(III)

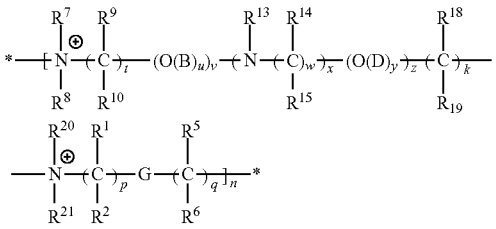

wherein:

G is selected from the group consisting of a single covalent bond, —O—, —O-((A)$_r$-O)$_s$— and -((A)$_r$-O)$_s$—

A has the structure,

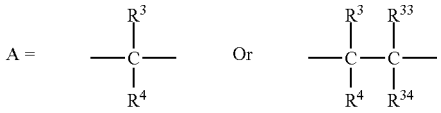

B has the structure,

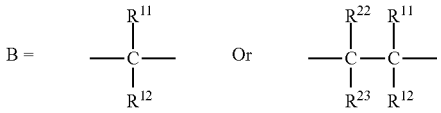

D has the structure,

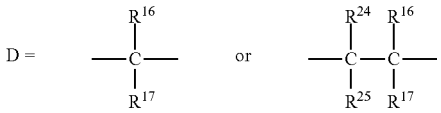

each of p, r, t, u, w, and y is an integer between 1 and 6 inclusive, each of q, v, x, k, and z is independently an integer between 0 and 6 inclusive, s is an integer between 1 and 10 inclusive, k is at least one when v or x is other than 0, q is at least one when G is other than a single covalent bond, at least one of v or z is at least one when G is a single covalent bond, each of $R^1$ to $R^6$, $R^9$ to $R^{19}$, $R^{23}$, $R^{25}$ and $R^{34}$ is independently selected from the group consisting of hydrogen or lower alkyl comprising 1 to 4 carbon atoms, each of $R^7$, $R^8$, $R^{20}$, $R^{21}$, $R^{22}$, $R^{24}$ and $R^{33}$ is independently selected from the group consisting of substituted or unsubstituted aliphatic hydrocarbyl having 1 to 4 carbon atoms, and n is between 1 and 30;

provided that, when prepared by reaction of an alkylated agent of structure (I)

(I)

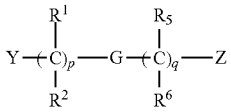

with an amine compound of structure (II)

(II)

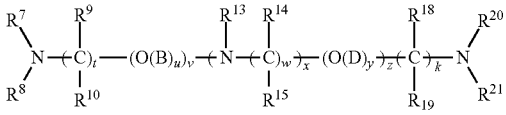

in which $R^{13}$ is hydrogen said leveler may comprise or consist of polymer or oligomer chains that correspond to structure (III) except that $R^{13}$ is displaced in some or all repeat units by reaction with the structure (I) alkylating agent through which said polymer or oligomer-chains are cross-linked.

2. The composition as set forth in claim 1 wherein G is —O—, —O-((A)$_r$-O)$_s$— or -((A)$_r$-O)$_s$—.

3. The composition as set forth in claim 2 wherein s is at least two.

4. The composition as set forth in claim 3 wherein $R^7$, $R^8$, $R^{20}$, $R^{21}$, $R^{33}$, and $R^{33}$ are methyl.

5. The composition as set forth in claim 1 wherein $R^{13}$ is alkyl.

6. The composition as set forth in claim 1 wherein x is at least one.

7. The composition as set forth in claim 1 wherein each of $R^7$, $R^8$, $R^{13}$, $R^{20}$, $R^{21}$, $R^{23}$, and $R^{33}$ is methyl.

8. The composition as set forth in claim 1 wherein said leveler comprises an oligomer or polymer compound selected from the group consisting of Structure Compound 21

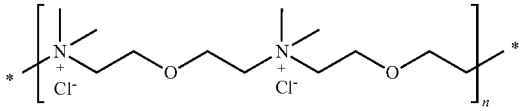

Structure

Compound 22

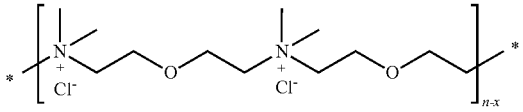

Structure

Compound 23

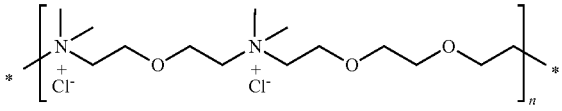

Structure

Compound designation 24

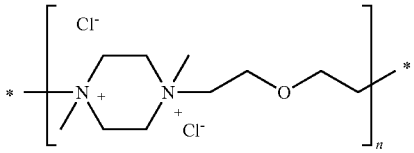

Structure

Compound 26

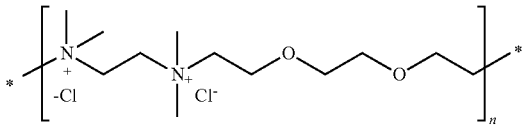

Structure

Compound 27

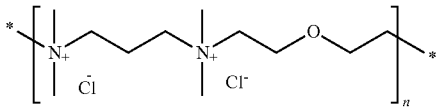

-continued

Structure

Compound 28

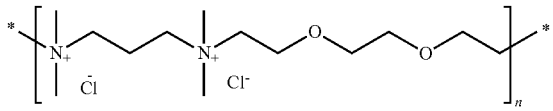

Structure

Structure

Compound 29

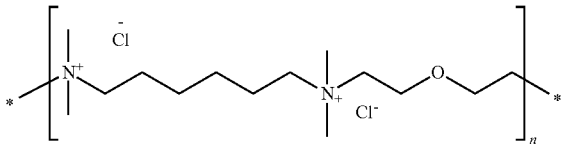

Structure

Compound 30

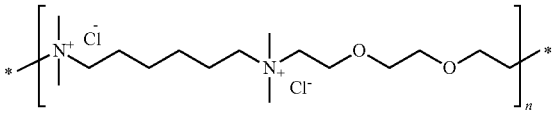

Structure

Compound 31

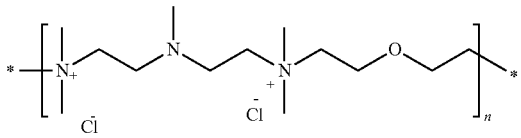

Structure

Compound 32

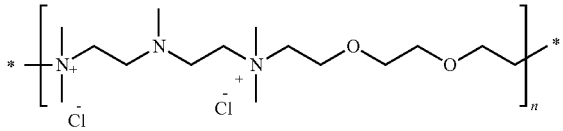

Compound 33

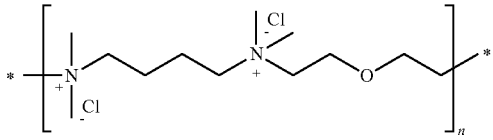

Compound 34

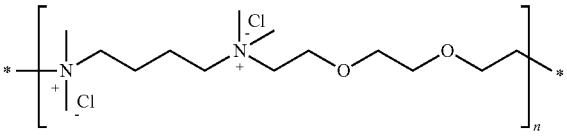

Compound 35

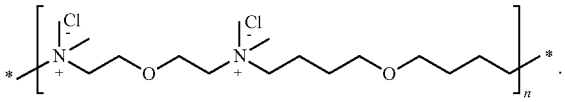

9. The composition as set forth in claim 1 wherein the leveler has an average molecular weight between about 1000 and about 5000.

* * * * *